US011266216B2

(12) United States Patent
Cudden

(10) Patent No.: US 11,266,216 B2
(45) Date of Patent: Mar. 8, 2022

(54) REMOVABLE STORAGE POUCH ASSEMBLY

(71) Applicant: Lynne Cudden, Mesa, AZ (US)

(72) Inventor: Lynne Cudden, Mesa, AZ (US)

( * ) Notice: Subject to any disclaimer, the term of this patent is extended or adjusted under 35 U.S.C. 154(b) by 0 days.

(21) Appl. No.: 17/120,679

(22) Filed: Dec. 14, 2020

(65) Prior Publication Data

US 2021/0093061 A1 Apr. 1, 2021

Related U.S. Application Data

(63) Continuation-in-part of application No. 16/362,306, filed on Mar. 22, 2019, now Pat. No. 10,863,805.

(60) Provisional application No. 62/647,138, filed on Mar. 23, 2018.

(51) Int. Cl.

| | |
|---|---|
| ***A45C 13/02*** | (2006.01) |
| ***A45C 15/06*** | (2006.01) |
| ***A45C 13/10*** | (2006.01) |

(52) U.S. Cl.

CPC ..... *A45C 13/02* (2013.01); *A45C 13/103* (2013.01); *A45C 15/06* (2013.01)

(58) Field of Classification Search

CPC ..... A45C 13/02; A45C 13/103; A45C 15/06
See application file for complete search history.

(56) References Cited

U.S. PATENT DOCUMENTS

| | | | |
|---|---|---|---|
| 2,179,214 | A | 11/1939 | Hallbauer |
| 2,304,387 | A | 12/1942 | Whiting et al. |
| 2,611,573 | A | 9/1952 | Young |
| 4,091,443 | A | 5/1978 | Ohrenstein et al. |
| 4,912,611 | A | 3/1990 | Lyle |
| 4,954,934 | A | 9/1990 | Kidder et al. |
| 5,038,271 | A | 8/1991 | Lobello |
| 5,073,844 | A | 12/1991 | Coyner |
| 5,444,605 | A | 8/1995 | Rivera |
| 5,613,756 | A | 3/1997 | Mien |
| 5,764,132 | A | 6/1998 | Hill |
| 6,132,059 | A | 10/2000 | Leibowitz |
| 6,447,142 | B1 | 9/2002 | Weir |
| 6,637,909 | B1 | 10/2003 | Bryan |
| 7,178,936 | B2 | 2/2007 | Lai |
| 8,944,628 | B2 | 2/2015 | Melamed |
| 9,696,017 | B2 | 7/2017 | Allen |
| 9,814,290 | B1 | 11/2017 | Winkler et al. |

(Continued)

*Primary Examiner* — Anabel Ton
(74) *Attorney, Agent, or Firm* — Simonelli IP, PLLC

(57) ABSTRACT

A removable storage pouch includes a pouch having a closeable opening providing access to an inner volume and three pouch attachment points coupled to an exterior side of the pouch. The removable storage pouch also includes a connector assembly comprising three corresponding pouch attachment points and two surface attachment points. Further, the removable storage pouch includes a removable light assembly operatively coupled to an inner surface of the pouch within the inner volume. Two of the three pouch attachment points of the pouch and two of the corresponding attachment points of the connector assembly are coupled together to complete an electrical circuit. The removable light assembly operatively coupled to an inner surface of the pouch includes electrical connectivity and removably coupling the light assembly to the inner surface of the pouch in order to light a light source of the light assembly.

6 Claims, 13 Drawing Sheets

(56) References Cited

U.S. PATENT DOCUMENTS

| | | | | |
|---|---|---|---|---|
| 10,271,626 | B1 | 4/2019 | Anderson | |
| 2003/0090895 | A1 | 5/2003 | Guerrier | |
| 2004/0090773 | A1 | 5/2004 | Bryan | |
| 2004/0174702 | A1 | 9/2004 | Guerrieri | |
| 2005/0174758 | A1* | 8/2005 | Fields | A45C 15/06 362/156 |
| 2005/0219839 | A1* | 10/2005 | Branson | A45C 15/06 362/156 |
| 2009/0070967 | A1 | 3/2009 | Gonzalez | |
| 2011/0170282 | A1 | 7/2011 | Munoz | |
| 2013/0271964 | A1 | 10/2013 | Rife | |
| 2015/0164191 | A1 | 6/2015 | Hause et al. | |
| 2016/0261695 | A1 | 9/2016 | Schaff et al. | |
| 2017/0020239 | A1 | 1/2017 | Cowdery | |
| 2018/0020812 | A1 | 1/2018 | Rao | |
| 2018/0317620 | A1 | 11/2018 | Larson | |
| 2021/0093061 | A1 | 4/2021 | Cudden | |

* cited by examiner

REMOVABLE STORAGE POUCH ASSEMBLY

CROSS REFERENCE TO RELATED APPLICATION[S]

This application is a continuation-in-part of U.S. patent application entitled "REMOVABLE STORAGE POUCH ASSEMBLY," Ser. No. 16/362,306, filed Mar. 22, 2019, which claims priority to U.S. Provisional Patent Application to Lynne Cudden entitled "REMOVABLE STORAGE POUCH," Ser. No. 62/647,138, filed Mar. 23, 2018, the disclosures of which are hereby incorporated entirely herein by reference.

BACKGROUND OF THE INVENTION

Technical Field

This invention relates generally to a pouch and more particularly to a removable storage pouch assembly that is attachable and detachable to another surface, such as, but not limited to, an interior surface of a bag or purse.

State of the Art

A conventional pouch for use with a bag, such as a purse, is typically placed loosely within the bag. The user then needs to search for the pouch within the bag in order to locate and utilize the pouch. The pouch is generally not readily available, making the usage of such a pouch ineffective regarding ease of access and use. Accordingly, there is a need for an improved pouch for use with a bag.

SUMMARY OF THE INVENTION

The present invention relates to removable storage pouch assembly for use with another surface, such as, but not limited to, an interior surface of a bag or purse.

An embodiment includes a removable storage pouch comprising a pouch having a closeable opening providing access to an inner volume and three pouch attachment points coupled to an exterior side of the pouch; a connector assembly comprising three corresponding pouch attachment points and two surface attachment points; and a removable light assembly operatively coupled to an inner surface of the pouch within the inner volume; wherein the two of the three pouch attachment points of the pouch and two of the corresponding attachment points of the connector assembly are coupled together to complete an electrical circuit, wherein the removable light assembly operatively coupled to an inner surface of the pouch includes electrical connectivity and removably coupling the light assembly to the inner surface of the pouch in order to light a light source of the light assembly.

Another embodiment includes a removable pouch assembly, comprising: a pouch, further comprising two pouch attachment points made of an electrically-conductive material and extend through the body to the inner volume thereof; a connector assembly comprising two inner member attachment points made of electrically-conductive material, wherein one attachment point is coupled to a top zipper tape and the other attachment point is coupled to a bottom zipper tape, and further comprising a metal zipper pull coupled to the top zipper tape and the bottom zipper tape, the metal zipper pull electrically connecting the attachment points when in pulled to fully unzip a zipper of the pouch; a light assembly comprising: a power source; at least one light electrically coupled to the power source; a first electrically-conductive attachment member coupled to the housing, the first electrically-conductive attachment member being electrically coupled to the at least one light source; and a second electrically-conductive attachment member coupled to the housing, the second electrically-conductive attachment member being electrically coupled to the power source, wherein each of the first and second electrically-conductive attachment member is coupled to an electrically-conductive pouch attachment point within the inner volume of the pouch, respectively, thereby completing an electrical circuit when the metal zipper pull fully unzips the zipper of the pouch to illuminate the at least one light source.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
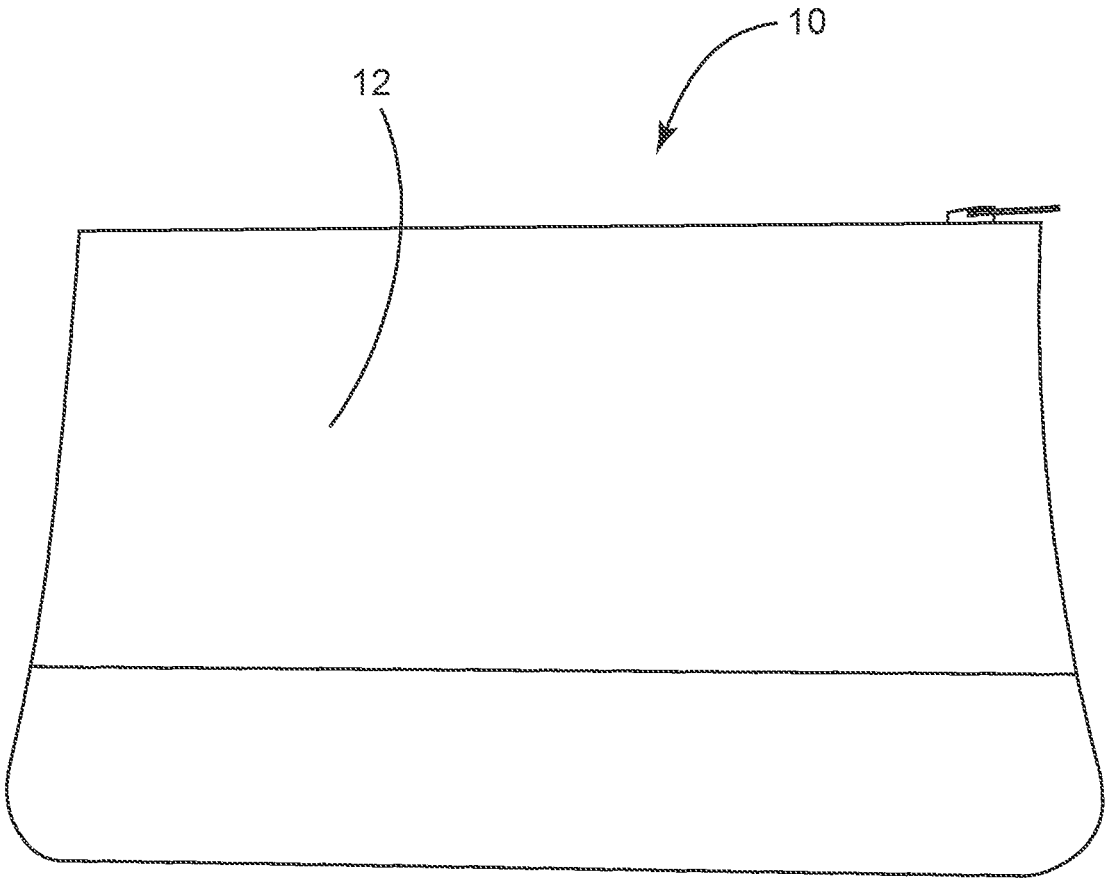
FIG. 1 is a front view of a removable storage pouch in accordance with an embodiment.
Figure 2:
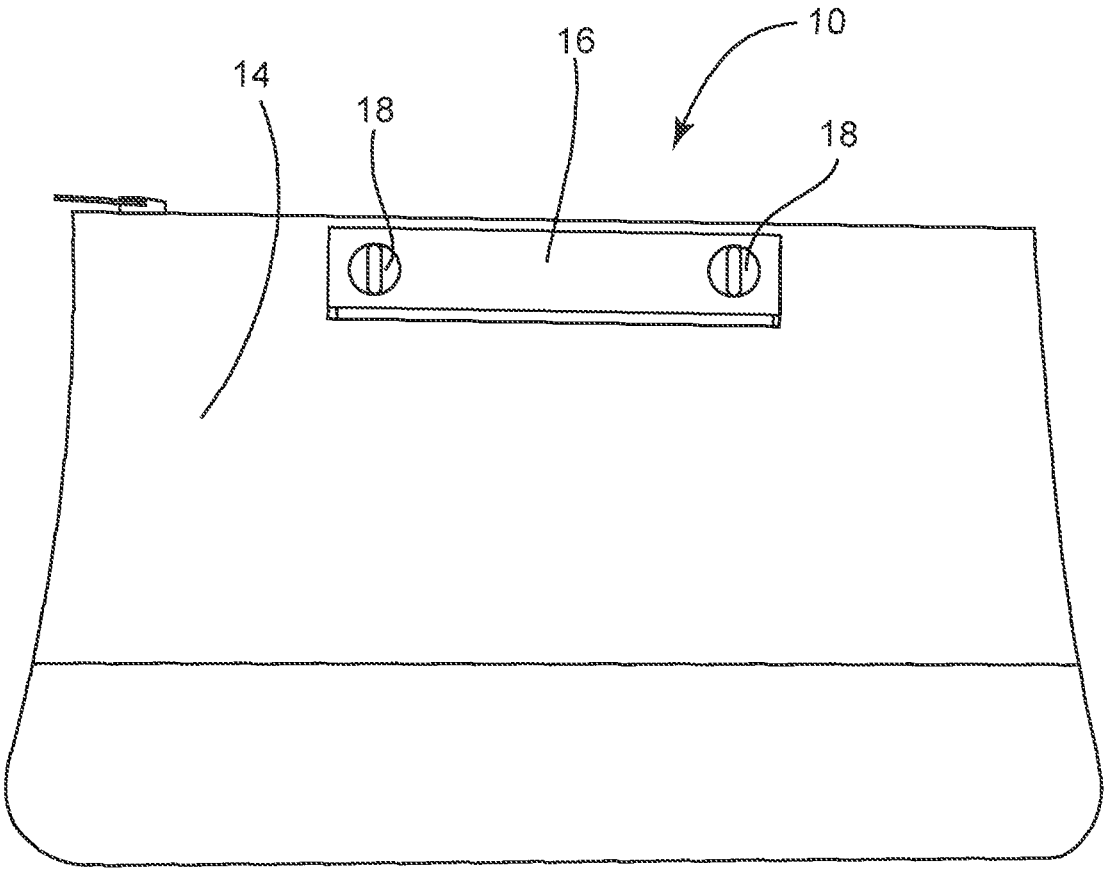
FIG. 2 is a rear view of a removable storage pouch in accordance with an embodiment.
Figure 3:
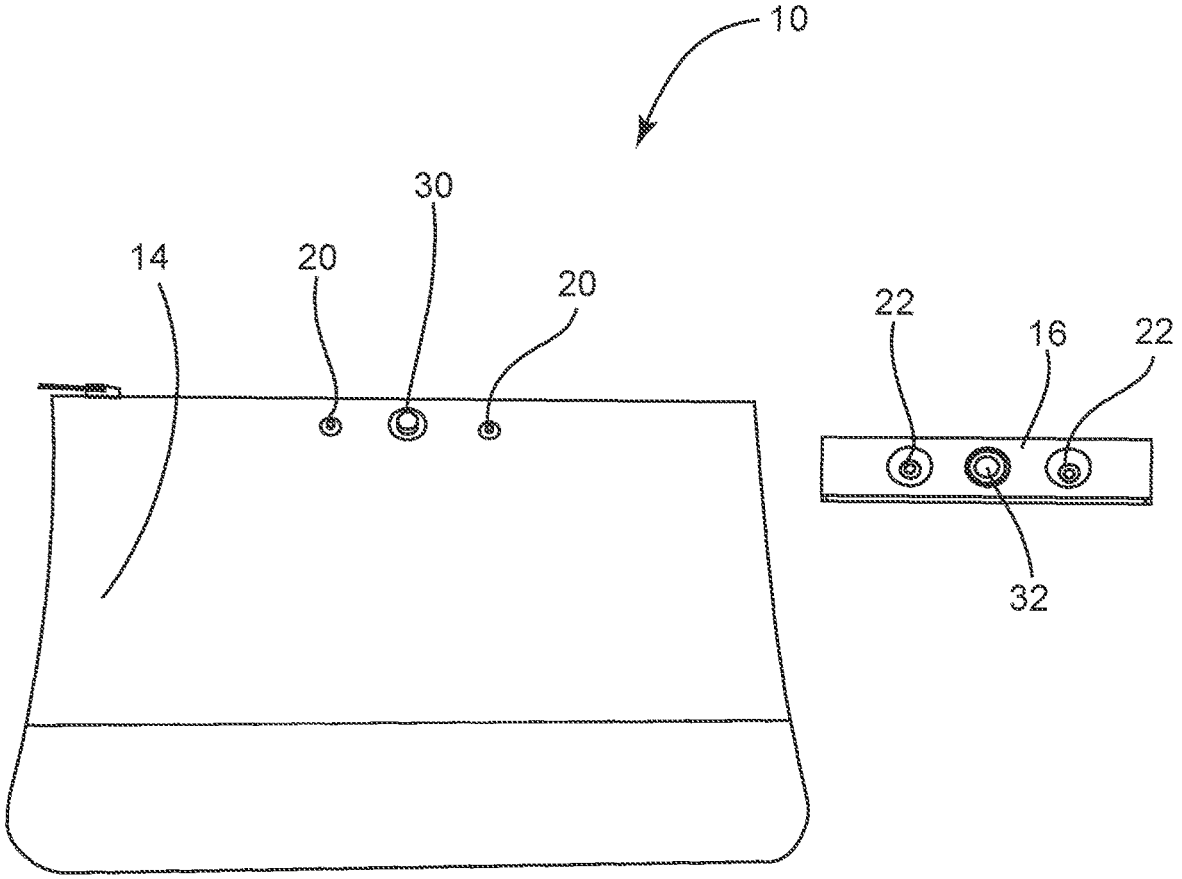
FIG. 3 is an exploded view of a removable storage pouch in accordance with an embodiment.
Figure 4:
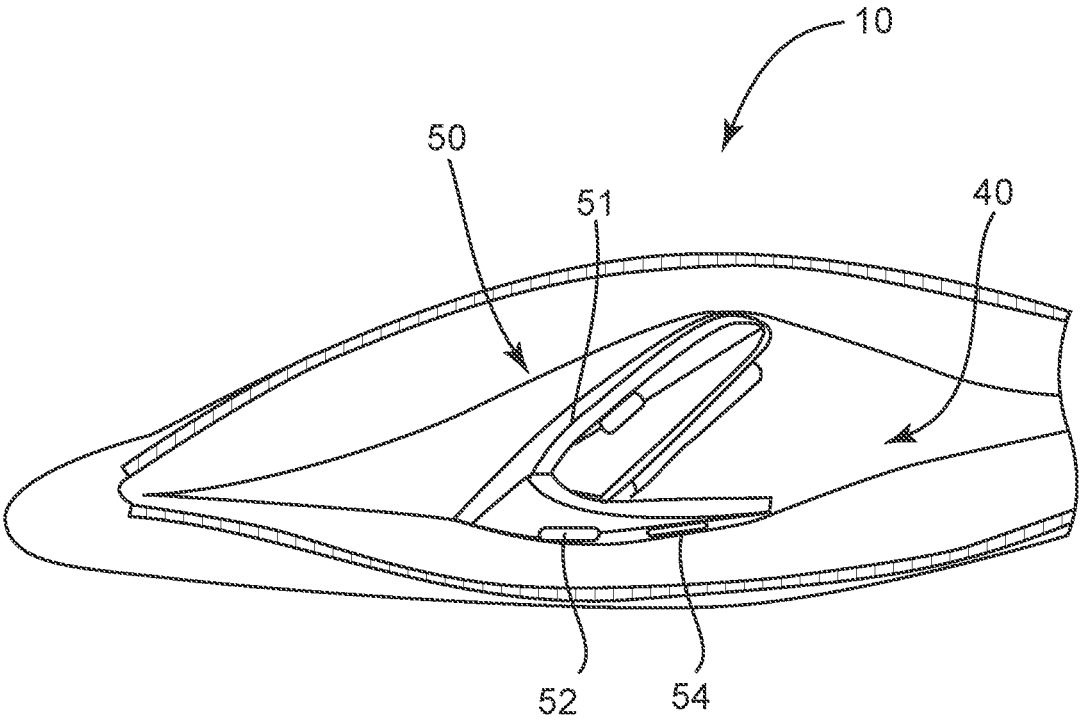
FIG. 4 is a perspective view of a removable storage pouch in an open position and light source unlit in accordance with an embodiment.
Figure 5:
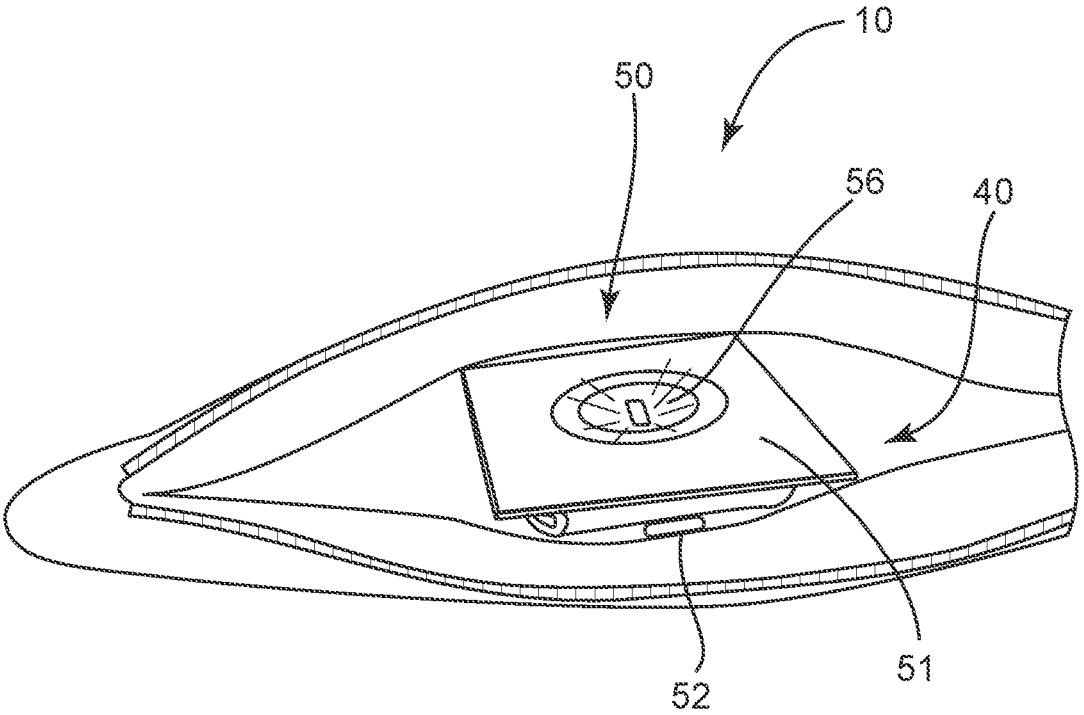
FIG. 5 is a perspective view of a removable storage pouch in an open position and light source lit in accordance with an embodiment.
Figure 6:
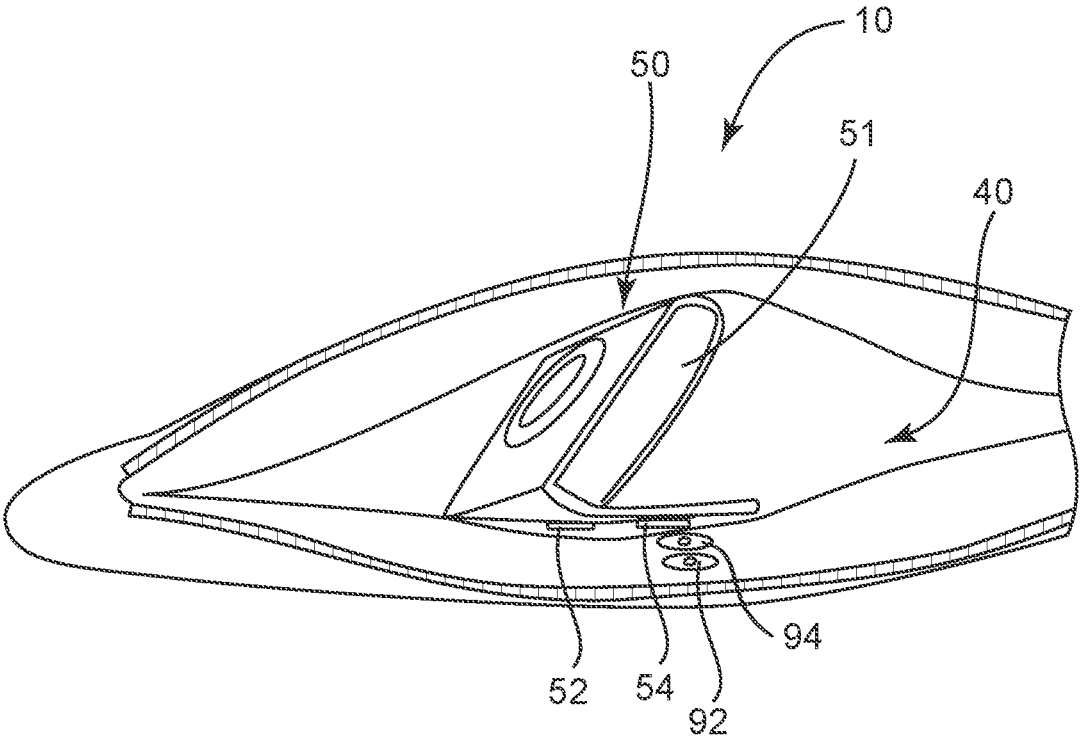
FIG. 6 is a perspective view of a removable storage pouch in an open position and light source unlit in accordance with an embodiment.

As discussed above, embodiments of the present invention relate to a removable storage pouch assembly with a light source. The removable storage pouch assembly is for use with another surface, such as, but not limited to, an interior surface of a bag or purse.

Referring to FIGS. 1-10, a removable pouch assembly of the present invention may include a small pouch 10, a connection member 16, and a light assembly 50. The pouch 10 comprises a front side 12, a back side 14, and a connection member 16 by which the pouch 10 may be securely connected to a surface for the purpose of adding small, convenient, removeable storage, and with the connection member 16 permitting the easy separation of the pouch from where it is connected.

The pouch 10 includes a plurality of attachment points 30 and 20 affixed by any means to a surface of the pouch, such as to the exterior of the back surface 14 of the pouch 10. In embodiments, the back surface 14 may be of a stiff material to provide support for the attachment points 30 and 20. These attachment points 30 and 20 comprise one side of a pouch joint by which the pouch 10 connects to the pouch joint on the inboard side of a connector assembly 16, on which is affixed the corresponding attachment points 32 and 22 for the pouch joint. The outboard side of the connector assembly 16 includes further attachment points 18 that comprise one side of a joint for the attachment of the connector assembly 16 and pouch to a surface, such as a bag, a purse, a case, or a pack, for example. The attachment points 18 comprising the other side of the joint are configured to be affixed to the surface to which the pouch 10 is to be attached.

With each of the above joints fully engaged, the pouch 10 is solidly affixed to a surface but can be easily removed by unsnapping the attachment points 30 and 20 of the pouch joint, thus separating the pouch 10 from the connector assembly 16 which remains securely affixed to the surface. The pouch 10 can once again be securely attached to the surface simply by re-engaging the attachment points 30 and 20 to the corresponding attachment points 32 and 22.

In an embodiment of the invention, male/female snaps 30 and 32 and 20 and 22 are used as the attachment points for the pouch joint with two of the snaps (20 and 22) composed of electrically-conductive material and forming a portion of an electrical circuit. Furthermore, within the connector assembly 16, the two attachment points 32 are connected via an electrically-conductive material, such as by electrical wire, for example. This electrical circuit additionally includes a pair of electrically conductive attachment member that comprises one side of an electrically-conductive accessory attachment joint on the interior surface of the pouch 10. The opposite conductive attachment member for the accessory attachment joint are integral components 52 and 54 of a light assembly 50, which includes any number of light sources 56 connected to a small power source (not shown). The power and light sources 56 are located within a flexible housing that includes the electrically conductive attachment member 52 and 54.

Figure 7:
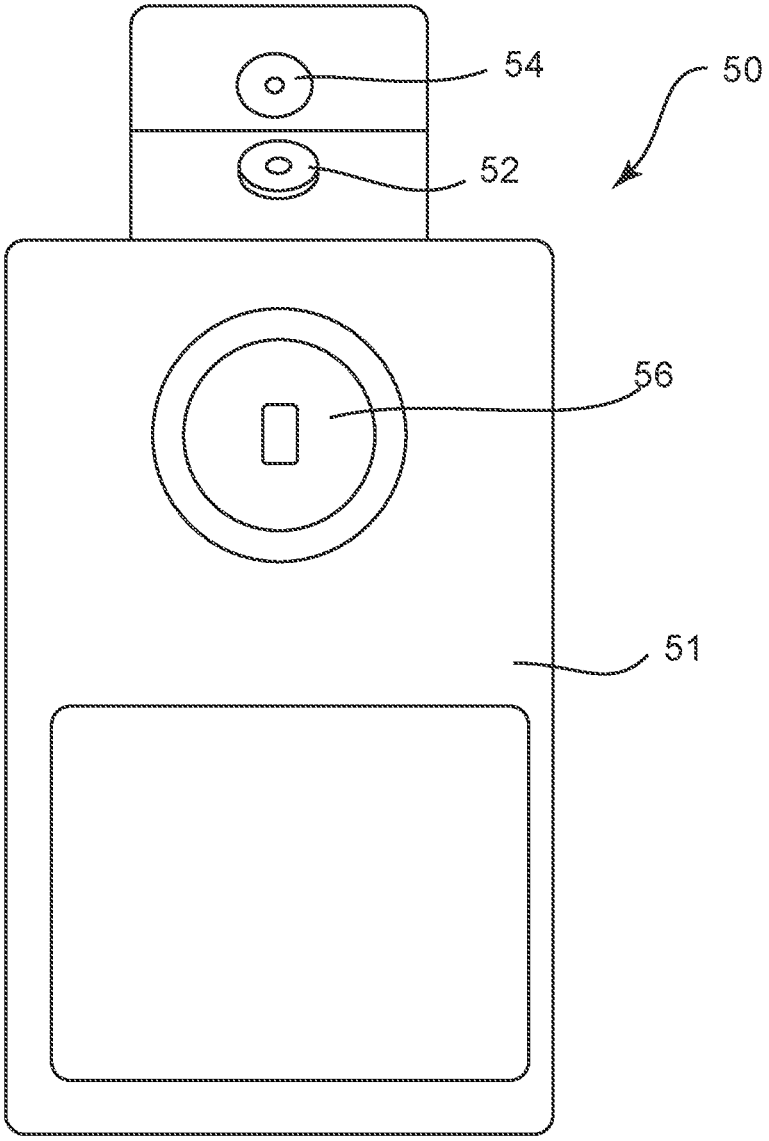
FIG. 7 is a front view of a light source unlit in accordance with an embodiment.
Figure 8:
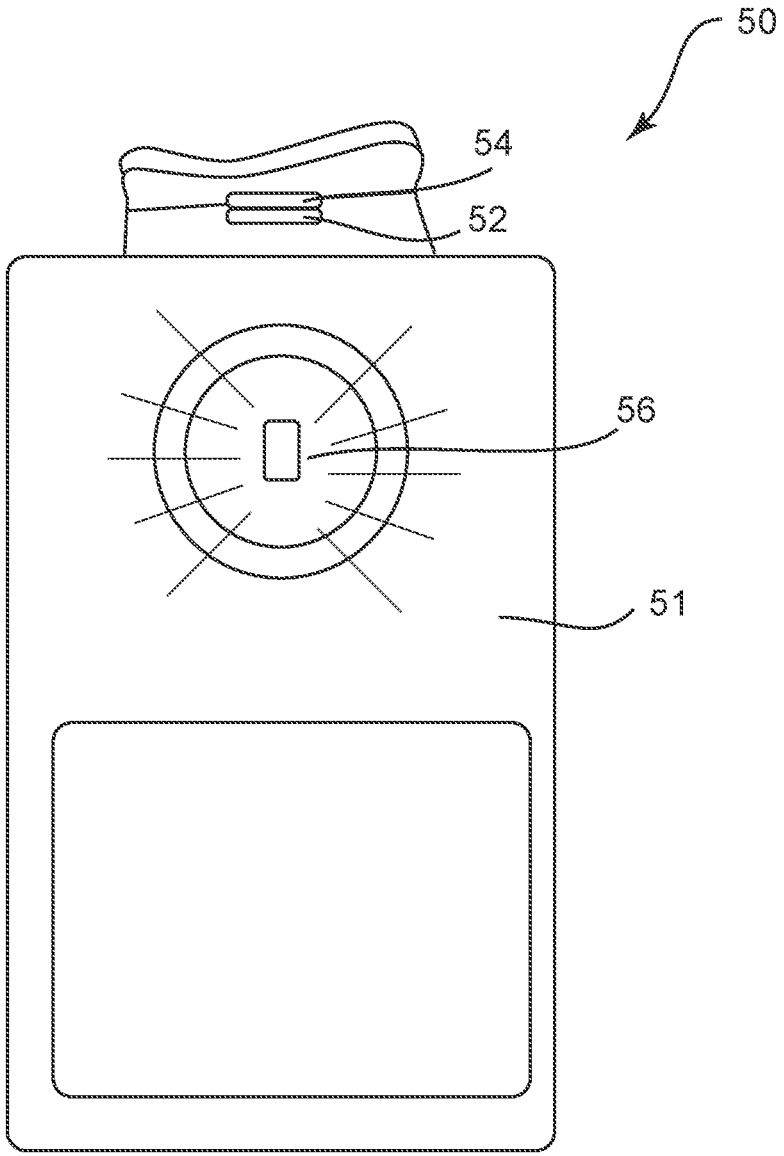
FIG. 8 is a front view of a light source lit in accordance with an embodiment.

When the pouch 10 is affixed to a surface and the light assembly 50 is connected to the pouch 10 via the accessory attachment joint an electrical circuit is formed from the power source (not shown), through the light source(s) 56, into the connector assembly via the first attachment member 52 of the accessory attachment joint, through a first set of attachment points 20 and 22, across the portion of the circuit portion in the connector assembly 16 to the second set of attachment points 22 and 20, and back to the power source via the second attachment member 54 of the accessory attachment joint. Thus, a closed circuit is formed with the light assembly 50 providing light to the pouch 10 interior and surrounding area. This circuit can be broken by unfixing any of the attachment member 52 or 54 or by a switch placed at a convenient location along the electrical circuit. In additional embodiments, as shown in FIGS. 7 and 8, the first attachment member 52 may be a female attachment member and the second attachment member 54 may be male attachments that can be coupled together to close a circuit and operate the light source 56 in conditions when the light assembly 50 is removed from within the pouch 10. This allows for external uses of the light assembly 50.

Figure 9:
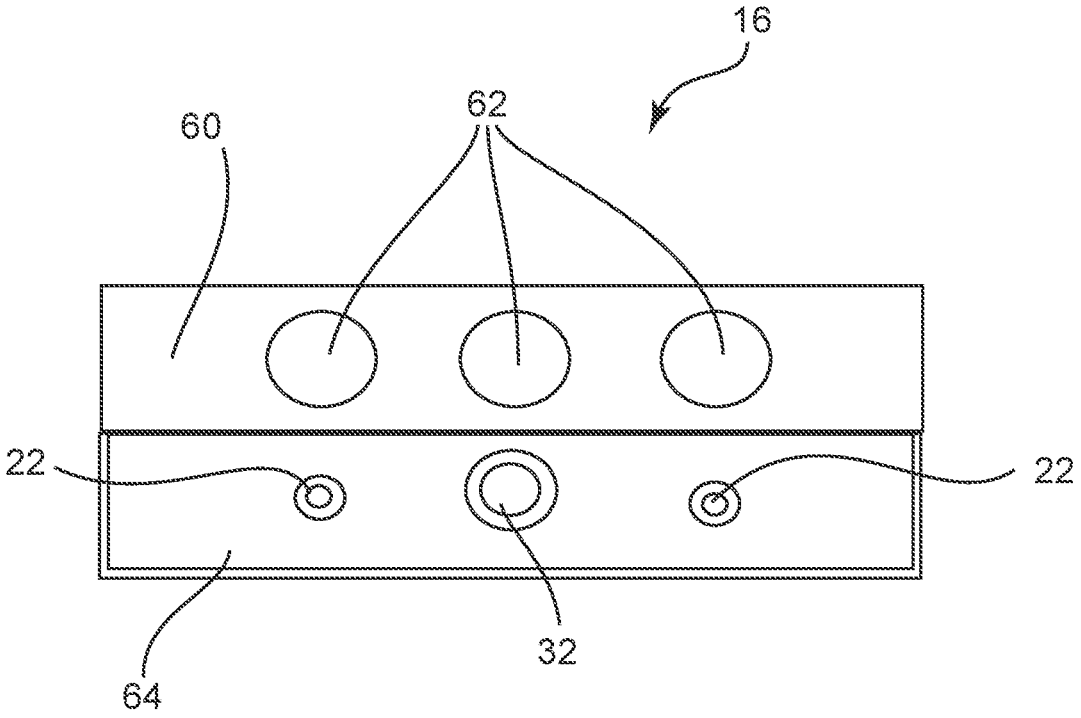
FIG. 9 is a perspective view of a connector assembly in accordance with an embodiment.
Figure 10:
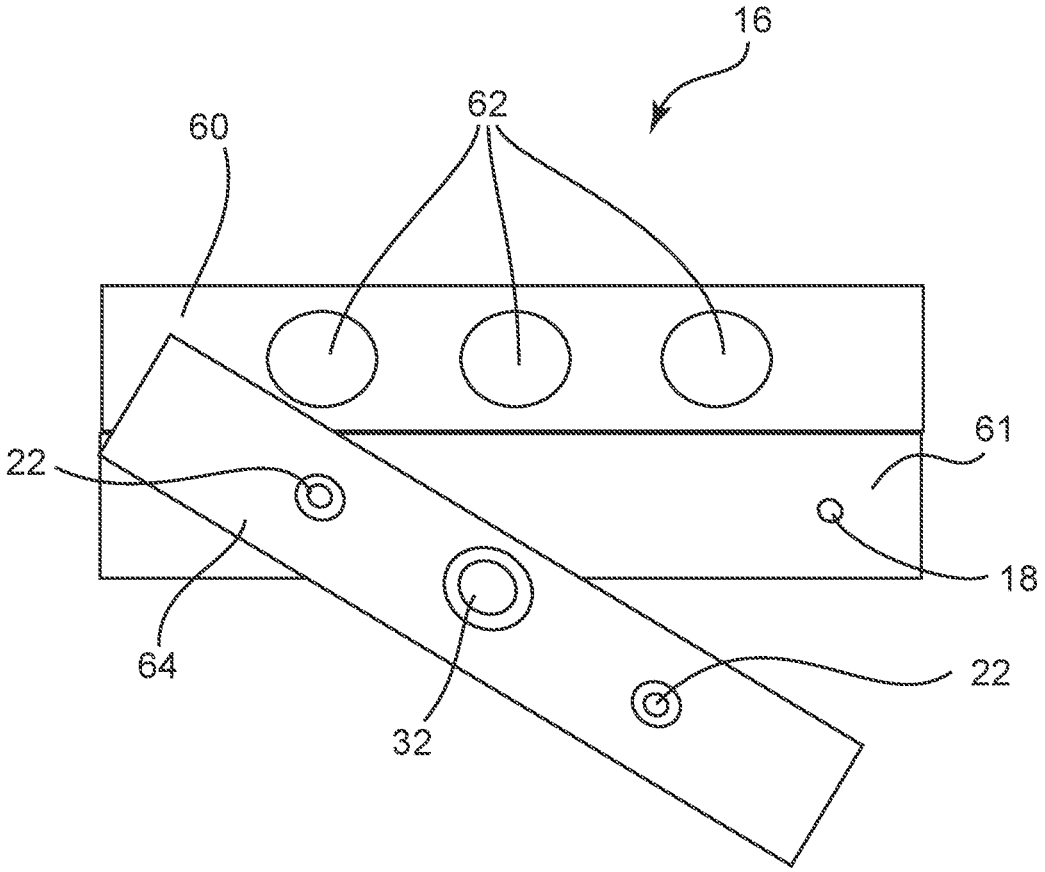
FIG. 10 is another perspective view of a connector assembly in accordance with an embodiment.

Referring specifically to FIGS. 9-10, the connector assembly 16 may include a folding member having a first portion 60 with apertures 62 extending through the first portion 60 and a second portion 61 having attachment points 18 for securing the folding member to a surface. The first portion 60 may be releasably coupled to the second portion 61 such as by use of a hook-and-loop fastener. The first portion 60 may be released and rotated away from the second portion 61 exposes and allows for removal of inner member 64, to which attachment points 32 and 22 are coupled to the inner member 64. The attachment points 32 and 22 are coupled to the inner member 64 in a position corresponding to the apertures 62 of the first portion 60 such that when the first portion 60 is coupled to the second portion 61 the attachment points 32 and 22 are exposed and have the ability to be secured to a pouch 10 as described above. This allows multiple folding members to be coupled to different surfaces, such as, but not limited to, different bags and using a single inner member 64 to be utilized with the multiple folding members. It will be appreciated that while FIGS. 9 and 10 depict a connector assembly 16 that includes a folding member having a first portion 60 and a second portion 61, some embodiments do not include a folding member. Embodiments that do not have a folding member may include the inner member 64 coupled to another member or material similar to the first portion 60 without a second portion 62 to fold over the inner member 64. In this embodiment the connector assembly 16 functions as intended.

Figure 11A:
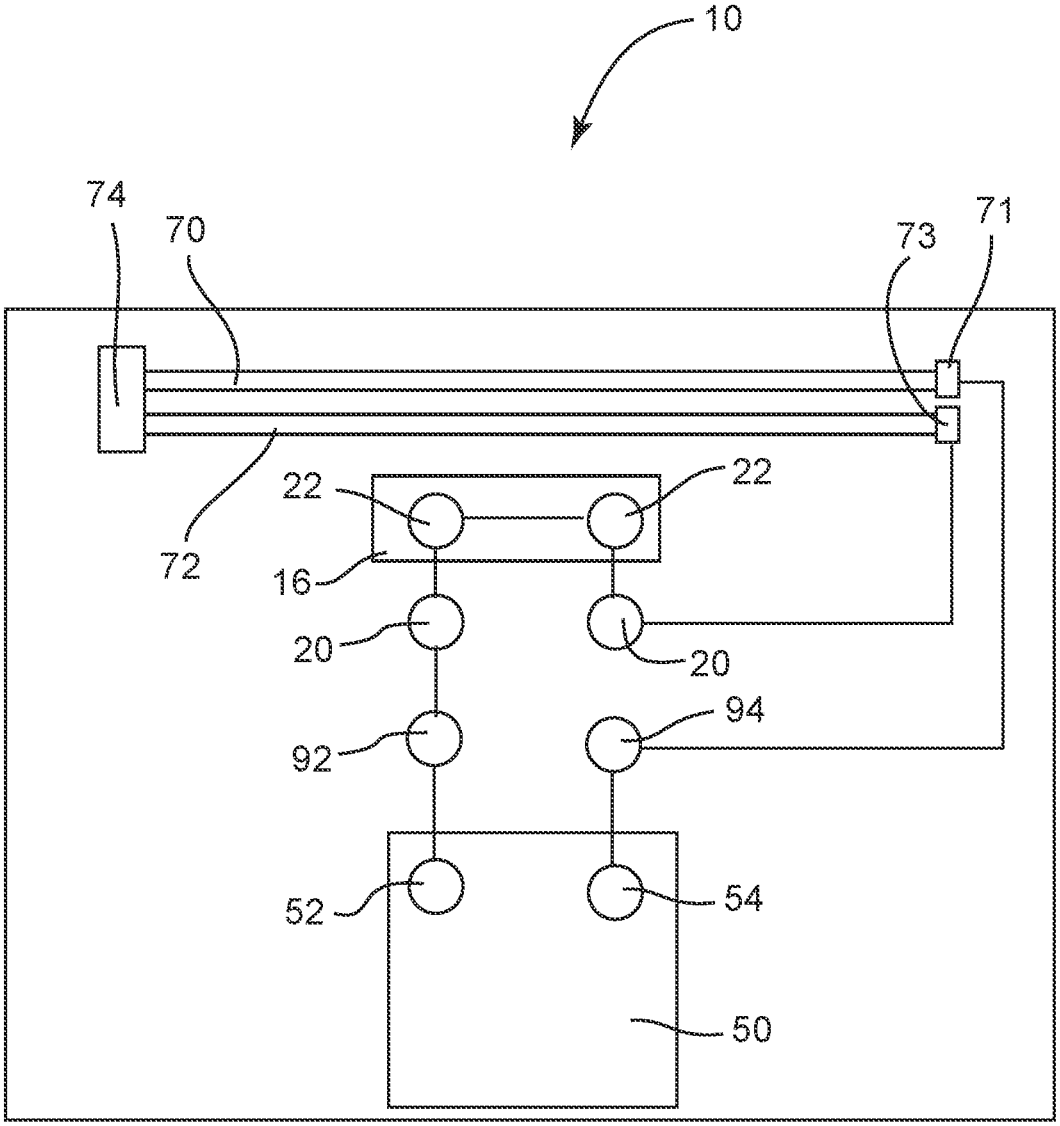
FIG. 11A is a schematic view of a removable storage pouch with a zipper closed in accordance with an embodiment.
Figure 11B:
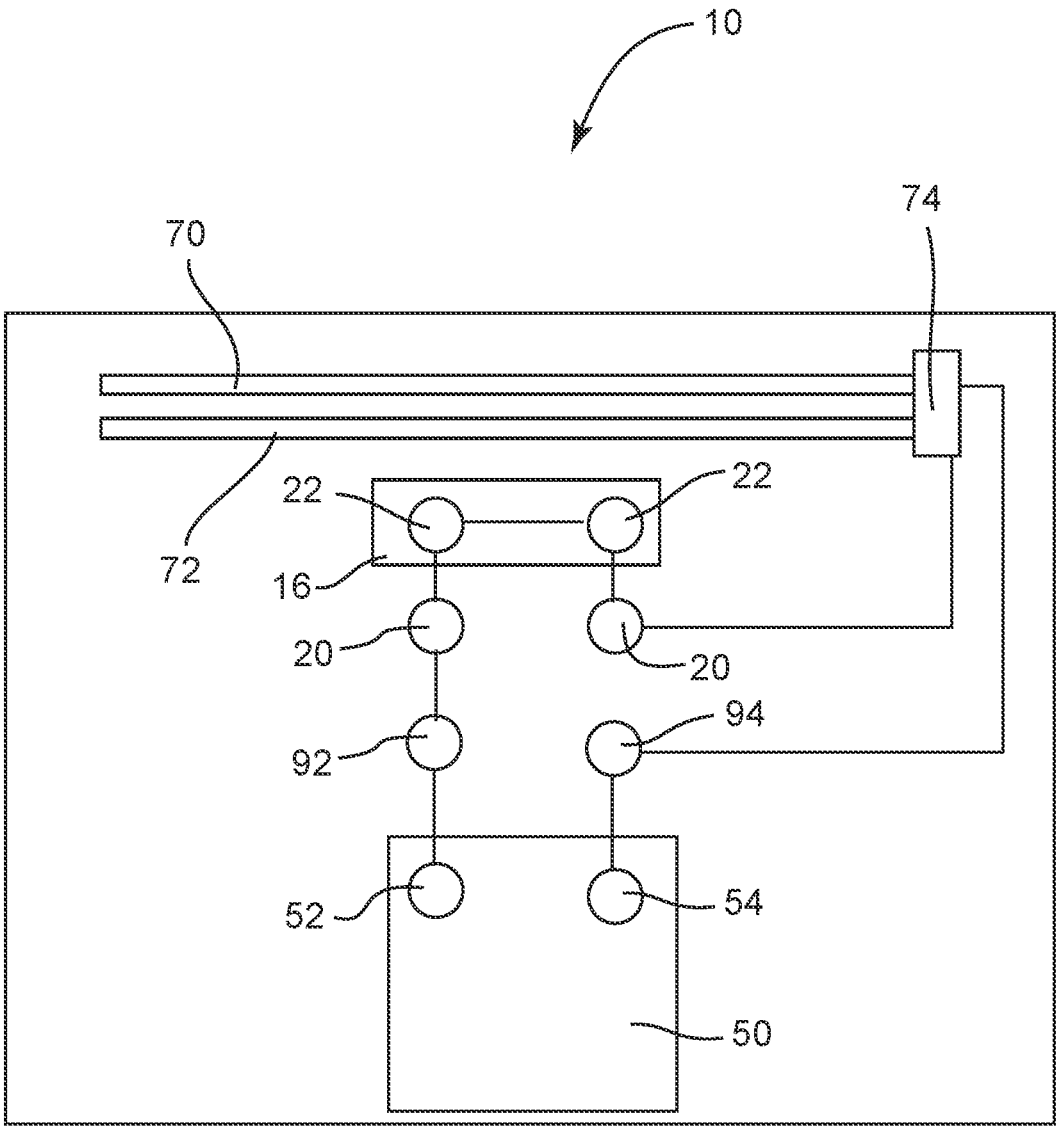
FIG. 11B is a schematic view of a removable storage pouch with a zipper opened in accordance with an embodiment.
Figure 12:
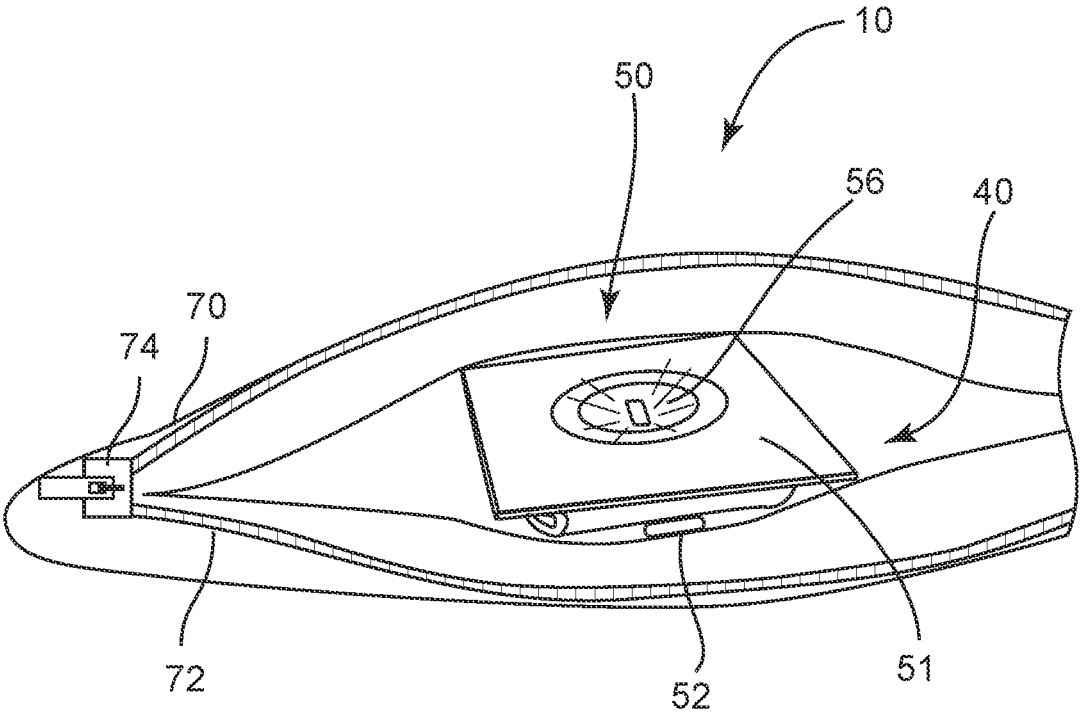
FIG. 12 is a perspective view of a removable storage pouch in an open position and light source lit in accordance with an embodiment.

Referring to the drawings, FIGS. 11A-12 depict another embodiment. The pouch 10 may include attachment points 20 and 22 composed of electrically-conductive material, such as electrical wire or conductive thread or the like, and forming a portion of an electrical circuit, and conductive connectors 92 and 94 (See FIGS. 6 and 11A). Conductive connector 94 may be coupled to a first zipper tape 70 with a first conductive connection member 7 land one attachment point 22 may be coupled to a second zipper member 72 with a second conductive connection member 73 (See FIG. 11A). A metal zipper pull 74 may be coupled to the zipper, where conductive connection members 71 and 73 on the first and second zipper tapes 70 and 72, respectively, are simultaneously contacted by the metal zipper pull 74 when the zipper pull 74 completely unzips the zipper of the pouch 10 (See FIG. 11B).

Therefore, integral components 52 and 54 of a light assembly 50, which includes any number of light sources 56, are connected to a small power source (not shown). The power and light sources 56 are located within a flexible housing that includes the electrically conductive attachment member 52 and 54. When the light assembly 50 is connected to the pouch 10 via a first and second conductive connectors 92 and 94, an electrical circuit is formed from the power source (not shown) to power and illuminate the light source(s) 56. The circuit includes the conductive attachment member 52 coupled to the first conductive connector 92 that is coupled to the attachment point 20, which is coupled to attachment point 22 and attachment point 22 is coupled to the second conductive connection member 73 coupled to the second zipper tape 72. The circuit further includes conductive attachment member 54 coupled to the second conductive connector 94, which is coupled to the first conductive connection member 71 coupled to the first zipper tape 70. The circuit is completed with the metal zipper pull contacting the first and second conductive connection members 71 and 73. This illuminated the light source(s) 56. Thus, a closed circuit is formed with the light assembly 50 providing light to the pouch 10 interior and surrounding area when the zipper pull 74 is pulled to a fully opened position. This circuit can be broken by unfixing any of the attachment member 52 or 54 or by pulling the zipper pull 74 toward a closed position.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

What is claimed is:

1. A removable pouch assembly, comprising:

a pouch defining an inner volume, said pouch comprising:

first and second pouch attachment points made of an electrically-conductive material;

a first conductive connection member coupled to a first zipper tape and electrically coupled to a first conductive connector;

a second conductive connection member coupled to a second zipper tape and electrically coupled to a second conductive connector;

said first conductive connector electrically coupled to said first pouch attachment point;

said second conductive connector electrically coupled to said second pouch attachment point; and a metal zipper pull coupled to said first and second zipper tapes;

a connector assembly comprising two inner member attachment points made of electrically-conductive material and electrically coupled to each other, wherein said connector assembly couples said first pouch attachment point to one of said two inner member attachment points and said second pouch attachment point to the other of said two inner member attachment points; and a light assembly including a housing having a power source and;

at least one light electrically coupled to said power source, a first electrically-conductive attachment member coupled to said housing, said first electrically-conductive attachment member being electrically coupled to said at least one light source, and a second electrically-conductive attachment member coupled to said housing, said second electrically-conductive attachment member being electrically coupled to said power source, wherein said first electrically-conductive attachment member is coupled to said first conductive connector and said second electrically-conductive attachment member is coupled to said second conductive connector within said inner volume of said pouch, thereby completing an electrical circuit when said metal zipper pull unzips said zipper of said pouch and contacts said first and second conductive connection members simultaneously to illuminate said at least one light source.

2. The removable pouch assembly of claim 1, wherein said pouch further comprises a body, having a closable opening that provides access to said inner volume.

3. The removable pouch assembly of claim 2, wherein said connector assembly further includes connector assembly attachment points that are removably coupled to said pouch attachment points of said pouch, wherein each of said connector assembly attachment points is removably coupled to one of said pouch attachment point of said pouch.

4. The removable pouch assembly of claim 3, wherein said at least one connector assembly attachment point is coupled to a surface of one of a purse, a bag, a case, or a pack.

5. The removable pouch assembly of claim 3, wherein each of said pouch attachment points of said pouch, said connector assembly attachment points, and said first and second electrically-conductive attachment members of said light assembly, is a snap fastener.

6. The removable pouch assembly of claim 3, wherein said first and second electrically-conductive attachment members of said light assembly is configured to be removably coupled together by a user, while said light assembly is detached from said pouch, thereby completing a circuit illuminating said at least one light.

* * * * *